US007782272B2

(12) United States Patent
Noro et al.

(10) Patent No.: US 7,782,272 B2
(45) Date of Patent: Aug. 24, 2010

(54) ANTENNA APPARATUS

(75) Inventors: Junichi Noro, Akita (JP); Takao Kato, Oga (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 119 days.

(21) Appl. No.: 11/901,473

(22) Filed: Sep. 17, 2007

(65) Prior Publication Data

US 2008/0074328 A1 Mar. 27, 2008

(30) Foreign Application Priority Data

Sep. 21, 2006 (JP) ..... 2006-255920

(51) Int. Cl.
*H01Q 1/36* (2006.01)
*H01Q 1/30* (2006.01)
*H01Q 1/42* (2006.01)
*H01Q 1/12* (2006.01)

(52) U.S. Cl. ..... 343/895; 343/872; 343/878; 343/900

(58) Field of Classification Search ..... 343/895, 343/878, 880, 882, 888, 892, 900
See application file for complete search history.

(56) References Cited

U.S. PATENT DOCUMENTS

| | | | | |
|---|---|---|---|---|
| 5,198,831 | A * | 3/1993 | Burrell et al. | 343/895 |
| 5,202,652 | A * | 4/1993 | Tabuchi et al. | 333/193 |
| 5,986,616 | A * | 11/1999 | Edvardsson | 343/853 |
| 6,421,029 | B1 * | 7/2002 | Tanabe | 343/895 |
| 6,531,986 | B2 * | 3/2003 | Saito | 343/702 |
| 6,653,987 | B1 * | 11/2003 | Lamensdorf et al. | 343/895 |
| 7,173,576 | B2 * | 2/2007 | O'Neill et al. | 343/895 |

FOREIGN PATENT DOCUMENTS

| | | |
|---|---|---|
| JP | 2001-339227 A | 12/2001 |
| JP | 2003-037430 A | 2/2003 |

* cited by examiner

*Primary Examiner*—Douglas W Owens
*Assistant Examiner*—Jennifer F Hu
(74) *Attorney, Agent, or Firm*—Frishauf, Holtz, Goodman & Chick, P.C.

(57) ABSTRACT

An antenna apparatus includes: an antenna element; and a substrate on which a low noise amplifier is mounted and on which the antenna element is disposed, wherein the substrate comprises: an input unit for inputting an electric signal into the low noise amplifier from an output terminal formed at a lower part of the antenna element; an output unit for outputting the electric signal to a transmission unit connected to a signal processing unit for processing the electric signal from the antenna element; and a signal blocking unit provided between the input unit and the output unit.

5 Claims, 8 Drawing Sheets

COMPARISON EXAMPLE

PRESENT INVENTION

ANTENNA APPARATUS

BACKGROUND OF THE INVENTION

1. Field of the Invention

The present invention relates to an antenna apparatus. In particular, the present invention relates to a cylindrical antenna apparatus.

2. Description of the Related Art

In recent years, a digital radio receiver that receives a satellite wave (an electric wave from an artificial satellite) or a ground wave (an electric wave on ground) so that a digital radio broadcasting can be received, has been developed. Such a digital radio receiver is generally provided in a movable body such as an automobile and can receive an electric wave having a frequency band of about 2.3 GHz so that radio broadcasting can be received. An antenna apparatus for receiving an electric wave having a frequency band of about 2.3 GHz includes, for example, a flat-type antenna (e.g., patch antenna) or a cylindrical antenna (e.g., loop antenna, helical antenna). An antenna apparatus is designed to be connected to a digital radio tuner via a cable and a connector.

A helical antenna is provided by surrounding a circular or columnar insulating member with at least one conducting wires in a helical manner and can receive a circular polarized wave (e.g., satellite wave) efficiently (see Patent Publication 1 for example). It is preferred that the number of conducting wires is larger in order to improve the receiver sensitivity. However, it is difficult to surround a circular or columnar insulating member with a plurality of conducting wires with a high accuracy.

Therefore, a technique for manufacturing a helical antenna by printing an antenna pattern having a plurality of conducting wires on one surface of a flexible dielectric material film and by forming the film in a cylinder shape, has been suggested (see Patent Publication 2 for example). In the case of such a helical antenna, a plurality of satellite waves (circular polarized waves) received by a plurality of conducting wires are synthesized by phase shift by a phase shifter to have an identical phase. Then, the synthesized satellite wave is amplified by a low noise amplifier (hereinafter referred to as "LNA") and is sent to a receiver. Specifically, a combination of the helical antenna, the phase shifter, and the LNA constitute an antenna apparatus.

The present inventors also have developed an antenna apparatus 1 in which a substrate on which an electronic part (e.g., LNA) is mounted is provided on the inner side of a helical antenna to reduce the length of the antenna apparatus in the axial direction (see FIG. 1). Such an antenna apparatus includes a tubular flexible dielectric material film in which an antenna pattern is printed on one surface; a substrate 50 on which an LNA is mounted and which is positioned on the inner side of the dielectric material film; and a tubular outer packaging case for covering the dielectric material film.

As shown in a development view of the dielectric material film (see FIG. 4), one surface of the dielectric material film includes a helical antenna section 12 on which an antenna pattern comprising a plurality of conducting wires is printed; and a phase shifter section 13 that is formed in a tubular shape and that functions as a phase shifter. When the dielectric material film is formed in a tubular shape, the helical antenna section 12 is positioned at the upper part in the axial direction and the phase shifter section 13 is positioned at the lower part thereof. On the lower end of the phase shifter section 13, an output terminal 16 of the phase shifter is provided. On the inner side of the tubular dielectric material film, a substrate 50 on which an LNA 20 electrically connected to an output terminal 16 and a cable 2 is mounted, is provided to extend along the axial direction.

[Patent Publication 1] Japanese Laid-Open Publication No. 2001-339227

[Patent Publication 2] Japanese Laid-Open Publication No. 2003-37430

However, in the conventional antenna apparatus, the output terminal 16 of the phase shifter is provided on the lower end of the tubular dielectric material film. Therefore, an input unit 51 for inputting a signal from the phase shifter at the lower part of the substrate 50 is required (see FIG. 9). Furthermore, because the cable 2 is provided at the lower part of the antenna apparatus, an output unit 52 for outputting a signal to the cable 2 also must be provided at the lower part of the substrate 50. Therefore, there was a problem where because the input unit 51 for inputting a signal from the phase shifter is adjacent to the output unit 52 for outputting a signal to the cable on the substrate 50, the isolation between an input and an output is not sufficient.

SUMMARY OF THE INVENTION

The present invention has been made in view of the above point. An object of the present invention is to provide an antenna apparatus in which the isolation between an input and an output can be secured in a substrate positioned on the inner side of a tubular helical antenna.

In accordance with a first aspect of the invention, an antenna apparatus, comprises:

an antenna element; and a substrate on which a low noise amplifier is mounted and on which the antenna element is disposed, wherein the substrate comprises:

an input unit for inputting an electric signal into the low noise amplifier from an output terminal formed at a lower part of the antenna element;

an output unit for outputting the electric signal to a transmission unit connected to a signal processing unit for processing the electric signal from the antenna element; and a signal blocking unit provided between the input unit and the output unit.

BRIEF DESCRIPTION OF THE DRAWINGS

The present invention will become more fully understood from the detailed description given hereinbelow and the accompanying drawing which are given by way of illustration only, and thus are not intended as a definition of the limits of the present invention, and wherein.

DETAILED DESCRIPTION OF THE PREFERRED EMBODIMENT

Hereinafter, one embodiment of an antenna apparatus according to the present invention will be described with reference to the drawings. However, the scope of the invention is not limited to illustrated examples.

Figure 1:
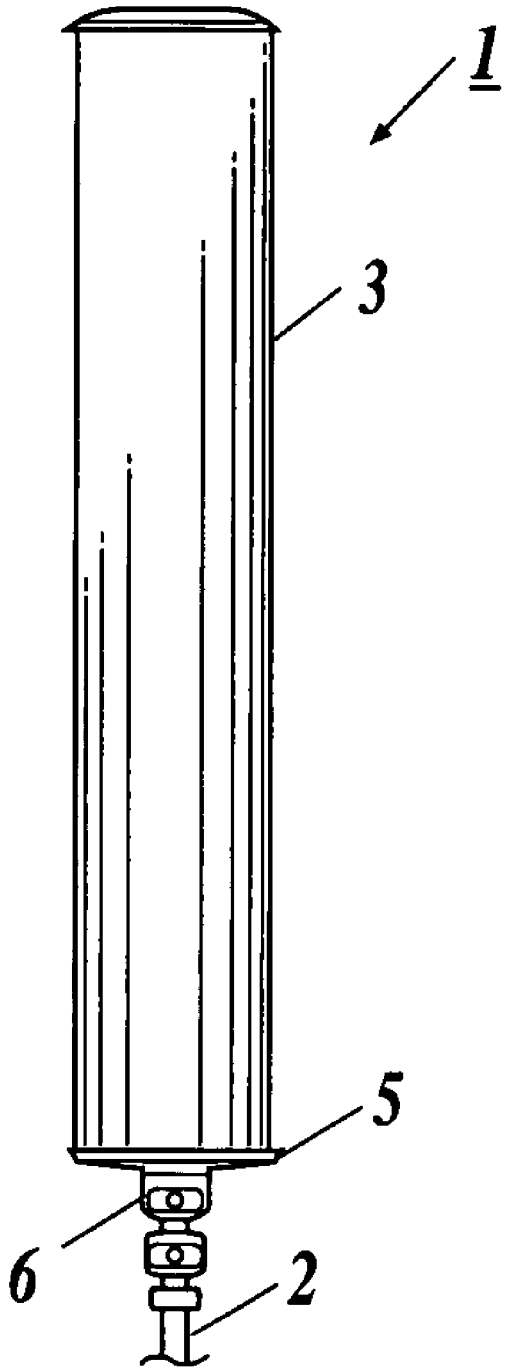
FIG. 1 is a side view illustrating an antenna apparatus according to this embodiment.
Figure 2A:
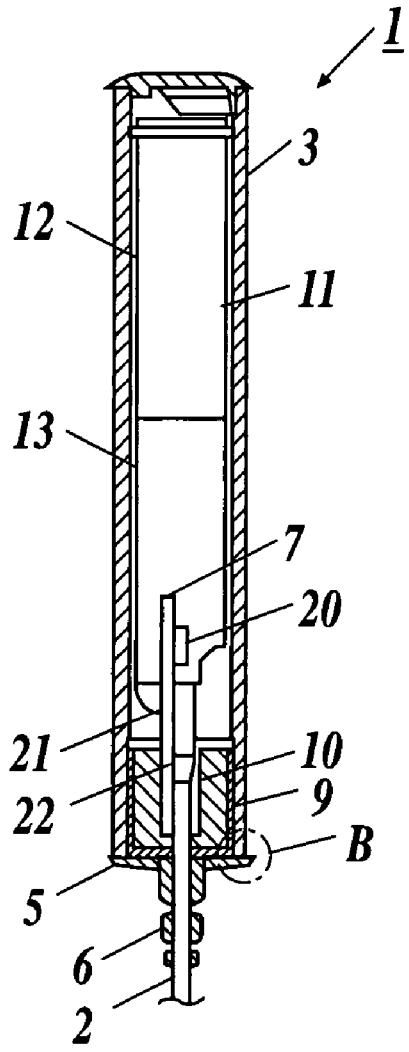
FIG. 2A is a longitudinal cross sectional view of the antenna apparatus according to this embodiment.

As shown in FIG. 1 and FIG. 2A, the antenna apparatus 1 in this embodiment is a cylindrical antenna for a digital radio receiver. The antenna apparatus 1 is connected to a digital radio tuner (not shown) as a signal processing unit via the cable 2 as a transmission unit. The digital radio tuner is housed in a casing of a portable electronic device (not shown) such as a portable audio equipment.

Figure 3:
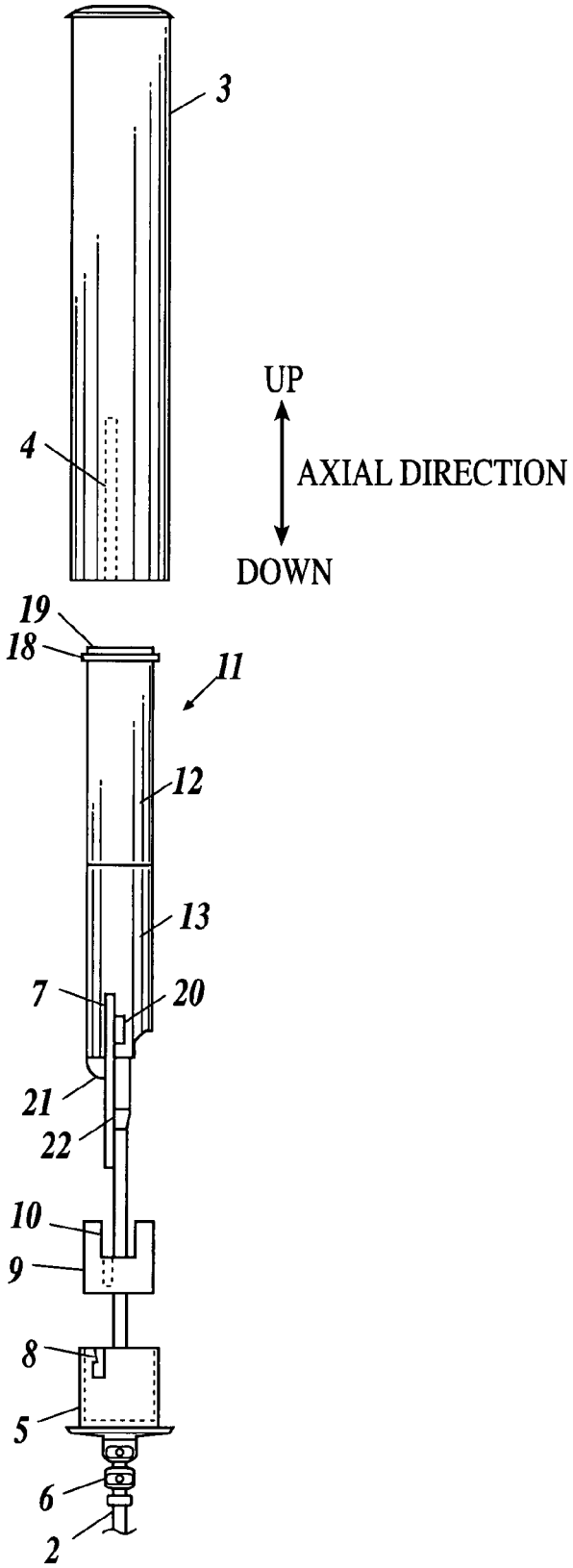
FIG. 3 is an exploded view of the antenna apparatus according to this embodiment.

As shown in FIG. 3, the antenna apparatus 1 includes an outer packaging case 3 having a cylinder shape in which the tip end in the axial direction is sealed. At the base end of the inner circumference face of the outer packaging case 3, a pair of grooves 4 are formed by cutting the outer packaging case 3 along the axial direction so that the grooves 4 are opposed to each other in the radial direction. Hereinafter, it is assumed that the upper side in the axial direction in FIG. 1 will be recognized as the tip end side of the antenna apparatus 1 and the lower side of the axial direction will be recognized as the base end side of the antenna apparatus 1.

The antenna apparatus 1 also includes an under cap 5 having a cylinder shape that seals the base end of the outer packaging case 3. The bottom face of the under cap 5 is penetrated by the cable 2 via a boot 6. On the outer circumference of the under cap 5, a pair of lock pawls 8 (which will be described later) which are locked to the substrate 7, are provided at symmetric positions in the radial direction. On the inner circumference side of the under cap 5, a packing 9 is provided in order to improve the waterproof property of the antenna apparatus 1. On the packing 9, a fitted penetration hole 10 (which will be described later) through which the substrate 7 and the cable 2 penetrate in a fitted manner, is formed in the axial direction.

On the inner side of the outer packaging case 3, the cylindrical body 11 which is formed by rolling a flexible dielectric material film member in a tubular shape, is coaxially provided. As shown in the development view of FIGS. 4A and 4B, one face of a dielectric material film constituting the inner circumference face of the cylindrical body 11 includes the helical antenna section 12 which is formed in a tubular shape and which functions as a helical antenna; and the phase shifter section 13 which is positioned at the lower portion of the helical antenna section 12 when the dielectric material film is formed in a tubular shape. A method for connecting the side edges of a dielectric material film by rolling the film in a tubular shape (in the direction shown by an arrow in FIG. 4) is not particularly limited. For example, the connection may be achieved by a double-faced adhesive tape, adhesive agent, or soldering for example.

Figure 4A:
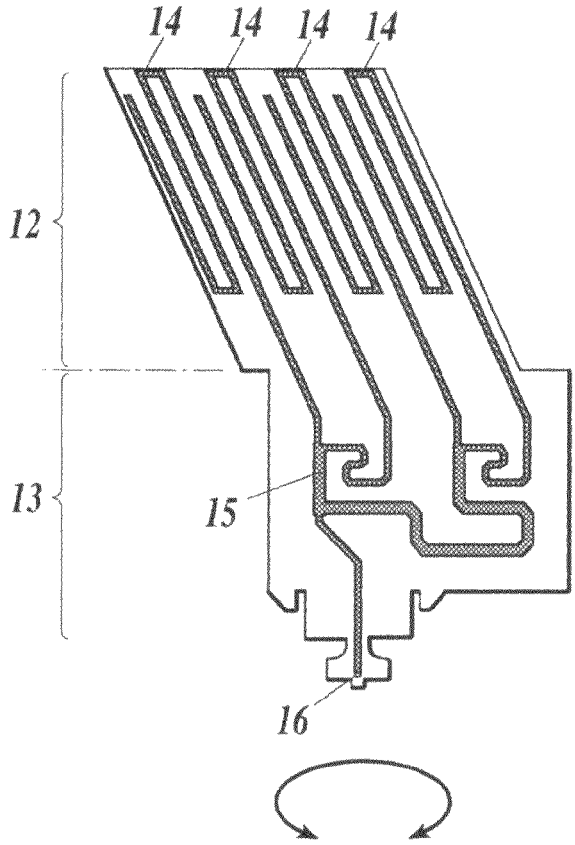
FIG. 4A is a development view illustrating one face of a dielectric material film constituting a cylindrical body.

As shown in FIG. 4A, in the helical antenna section 12 having a substantially parallelogram-like shape, an antenna pattern comprising four conducting wires 14 is formed. Each of the conducting wires 14 is formed so as to function as a helical antenna by drawing a helical line when a dielectric material film is formed in a tubular shape. The number and the shape of the conducting wires 14 are not particularly limited and can be appropriately changed.

In the phase shifter section 13 having a substantially rectangular shape, phase shifter patterns 15 electrically connected to each of conducting wires 14, are formed. The phase shifter patterns 15 are formed to function as a phase shifter for coinciding phases of signals from each of the conducting wires 14 when the film is rolled in a tubular shape. At an end of the phase shifter pattern 15, an output terminal 16 for outputting a signal obtained by synthesizing signals from each of the conducting wires 14 is provided.

Figure 4B:
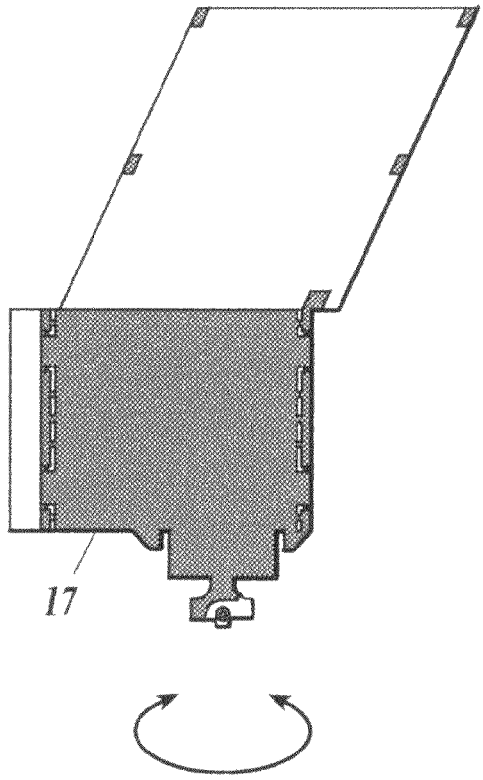
FIG. 4B is a development view illustrating the other face of the dielectric material film.

As shown in FIG. 4B, at a position which is on the other face of the dielectric material film constituting the outer circumference face of the cylindrical body 11 and which is opposed to the phase shifter pattern 15, a ground face 17 which functions as a ground of the helical antenna is formed. The ground face 17 in this embodiment is formed over the substantially entire area of the opposite face of the phase shifter section 13. The ground face 17 may have any shape so long as the ground face 17 can function as a ground. However, the ground face 17 is preferably formed to cover at least the phase shifter pattern 15 because the ground face 17 can function as a shield member of the phase shifter.

As shown in FIG. 3, at an upper end of the cylindrical body 11, a circular cushion 18 is provided to retain a space between the cylindrical body 11 and the outer packaging case 3. The circular cushion 18 is made by elastic material such as urethane foam and is provided so that the outer circumference face of the circular cushion 18 is abutted to the inner circumference face of the outer packaging case 3. In other words, the circular cushion 18 retains a space between the cylindrical body 11 and the outer packaging case 3 at a constant so that the cylindrical body 11 and the outer packaging case 3 can be always positioned in a coaxial manner.

In the outer circumference of the cylindrical body 11 at the upper position of the circular cushion 18, a space adjusting member 19 for adjusting a space between the sealed face of the outer packaging case 3 and the cylindrical body 11, is provided. The space adjusting member 19 is provided on the outer circumference face of the cylindrical body 11 and is made of material which changes a dielectric constant of a tip end of the helical antenna (e.g., urethane foam). Specifically, by changing the size or material of the space adjusting member 19 or the like, the frequency characteristic of the antenna apparatus 1 is adjusted. In this embodiment, the circular cushion 18 also may be integrated with the space adjusting member 19 by urethane foam.

Figure 5:
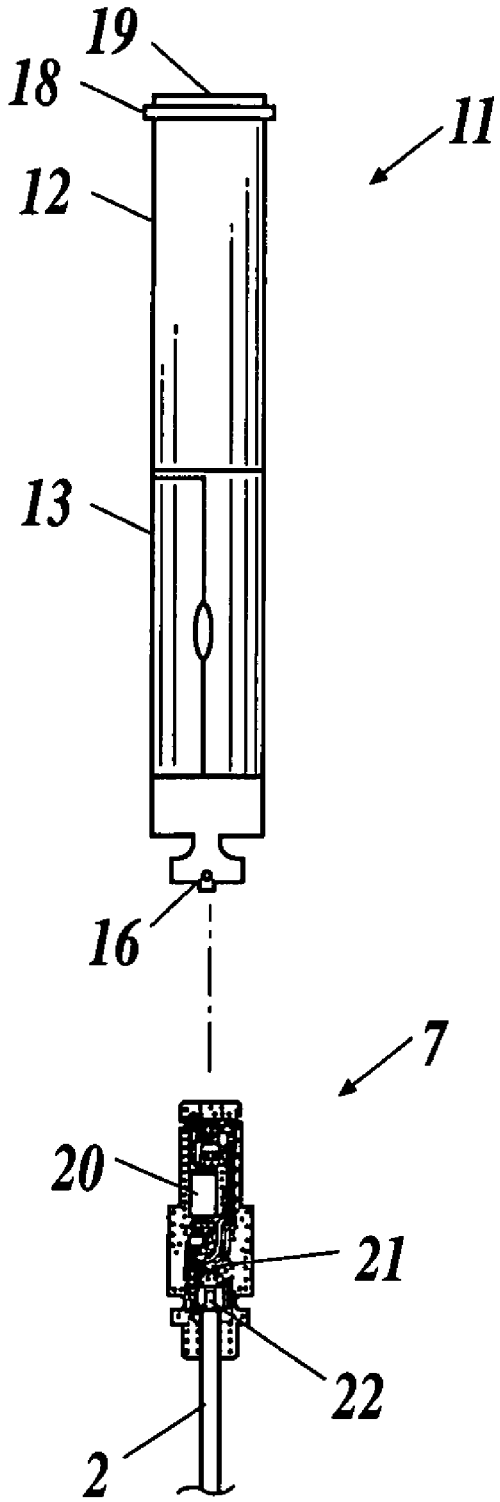
FIG. 5 is an exploded view illustrating the cylindrical body and a substrate.

At the lower position of the inner side of the cylindrical body 11, the flat plate-like substrate 7 is disposed so as to be opposed to a region on which the output terminal 16 of the phase shifter pattern 15 is formed and so as to set the longitudinal direction thereof along the axial direction (see FIG. 5). The substrate 7 may have any outer shape so long as a surface-mounted component can be mounted on the substrate 7. Material for the substrate 7 is not particularly limited. A known dielectric material (insulating material) can be used depending on a desired dielectric constant.

Figure 6:
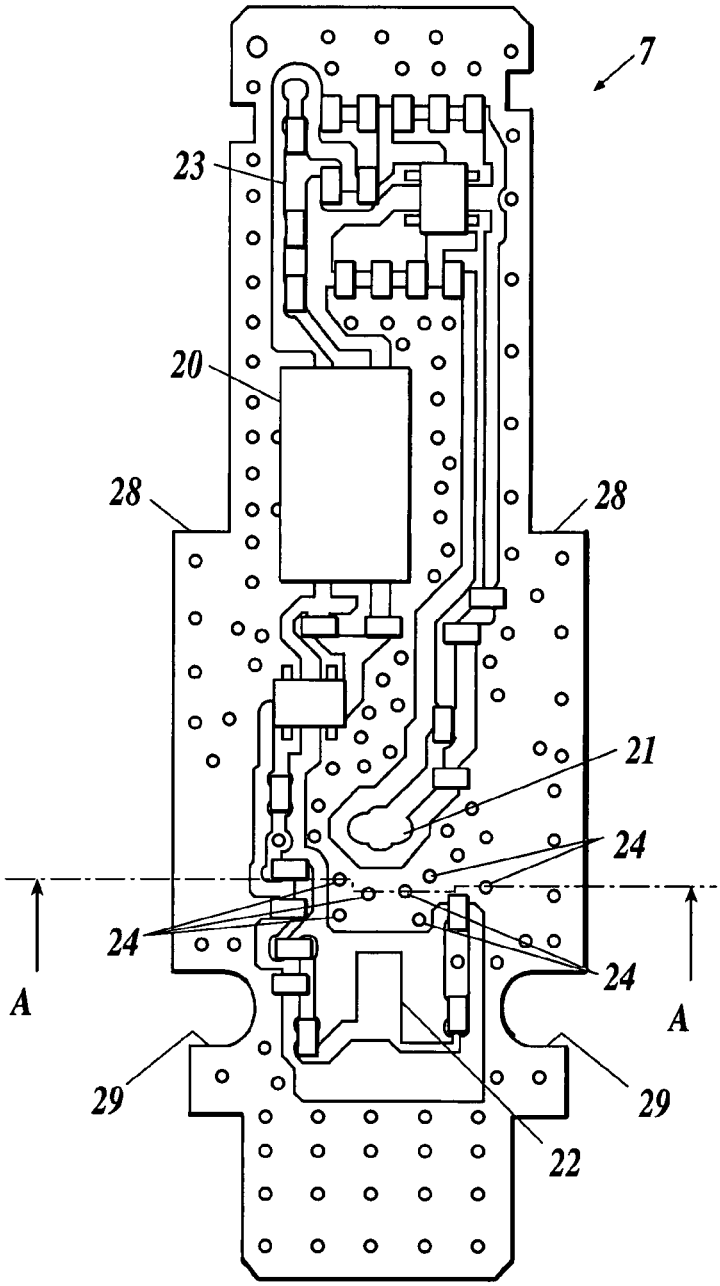
FIG. 6 is a plan view illustrating the substrate according to this embodiment.

As shown in FIG. 6, on the surface of the substrate 7, the LNA 20 for amplifying a signal from the output terminal 16 is mounted. An input unit 21 which is electrically connected to the output terminal 16 of the phase shifter and from which a signal is inputted, is provided at the lower side of the LNA 20 on the surface of the substrate 7. An output unit 22 for outputting the signal amplified by the LNA 20 to outside is provided at the lower side of the input unit 21 on the surface of the substrate 7. On the substrate 7, a conduction pattern 23 for connecting from the input unit 21 to the output unit 22 via the LNA 20, is formed.

Figure 7:
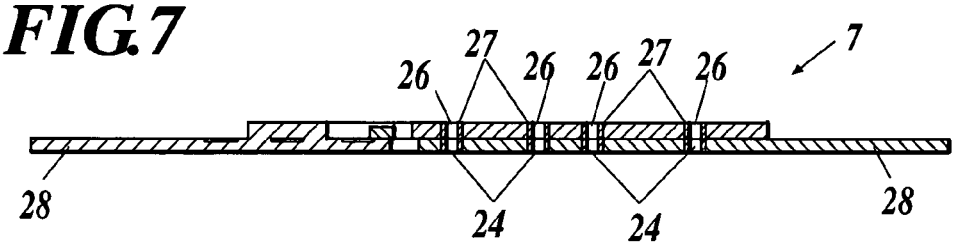
FIG. 7 is a cross-sectional view taken along the line A-A in FIG. 6.

In a region between the input unit 21 and the output unit 22 on the surface of the substrate 7, a plurality of through holes 24 is provided as a signal blocking unit. As shown in FIG. 7, each of the through holes 24 is formed by plating an inner circumference face of a hole section 26 penetrating the substrate 7 with a conductive member 27 made of copper or the like to induce an electric field between the input unit 21 and the output unit 22. It is noted that any signal blocking unit may be used so long as the signal blocking unit can induce an electric field between the input unit 21 and the output unit 22 to prevent an interference therebetween. For example, a signal blocking unit made of a metal pin for example may be used. In this embodiment, a plurality of through holes are formed over the entire surface of the substrate 7.

An electrical connection between the input unit 21 and the output terminal 16 and an electrical connection between the output unit 22 and the cable 2 are not limited to a particular method and may be suitably changed. In this embodiment, a region on which the output terminal 16 of a dielectric material film constituting the cylindrical body 11 is formed, is curved to the inner side and the input unit 21 is connected to the output terminal 16 by soldering. The output unit 22 is fixed with one end of the cable 2 by soldering (see FIG. 5) so that an amplified signal can be sent to a digital radio tuner via the cable 2.

On both side edges of the substrate 7, engagement sections 28 which externally protrude from the cylindrical body 11 to be engaged with the grooves 4 of the outer packaging case 3 are provided. Notches 29 to be engaged with the lock pawls 8 of the under cap 5 are provided at the side edges of the substrate 7 in the lower part of the engagement section 28. The shapes and the numbers of the engagement sections 28 and the notches 29 are not particularly limited and may be any shapes and numbers so long as the substrate 7 can be fixed to the outer packaging case 3 or the under cap 5.

Next, a method for manufacturing the antenna apparatus 1 in this embodiment will be described.

First, on one face of a dielectric material film constituting the cylindrical body 11, the conducting wire 14 and the phase shifter pattern 15 are formed. On the other face thereof, the ground face 17 is formed. Then, the dielectric material film is rolled in a tubular shape and is fixed so that the helical antenna section 12 is positioned at the upper side in the axial direction on the inner circumference face. Then, the cylindrical body 11 is formed.

Next, the lower end of the substrate 7 on which the LNA 20 is mounted is inserted to the inner side of the cylindrical body 11 so that the output terminal 16 of the phase shifter pattern 15 is opposed to the input unit 21. Then, a region on which the output terminal 16 of the dielectric material film is formed, is curved to the substrate 7 and is fixed by soldering. In this manner, the helical antenna, the phase shifter, and the LNA 20 are electrically connected.

On the other hand, the under cap 5, the boot 6, and the packing 9 is previously penetrated by one end of the cable 2 in this order. Then, one end of the cable 2 is fixed to the output unit 22 of the substrate 7 by soldering. After, the cable 2 is fixed to the substrate 7, the substrate 7 is inserted to the fitted penetration hole 10 of the packing 9 to sandwich the boot 6 between the packing 9 and the under cap 5. As a result, the lock pawl 8 of the under cap 5 is locked by the notch 29 of the substrate 7, and the fixation of the under cap 5, the boot 6, the packing 9, and the substrate 7 is completed.

Figure 2B:
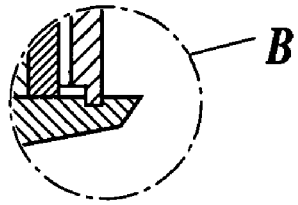
FIG. 2B is a partial expanded view thereof.

Thereafter, the circular cushion 18 and the space adjusting member 19 are attached to the upper end of the cylindrical body 11 in this order. Then, the cylindrical body 11 is inserted to the outer packaging case 3 from the upper end thereof to engage the engagement section 28 of the substrate 7 with the groove 4 of the outer packaging case 3. Then, the lower end of the outer packaging case 3 is joined with the under cap 5 by ultrasonic welding to seal the antenna apparatus 1 (see FIG. 2B).

Next, the operation of the antenna apparatus 1 in this embodiment will be described.

When each of the conducting wires 14 receives electric waves in the helical antenna section 12, each signal enters the phase shifter pattern 15. Then, the signals outputted from each of the conducting wire 14 are phase-shifted by the phase shifter pattern 15 to synthesize one signal and the phase shifter pattern 15 sends the signal to the output terminal 16. In this case, the ground face 17 functions both as a ground of a helical antenna and a shield member of the phase shifter pattern 15.

The signal sent to the output terminal 16 is inputted from the input unit 21 of the substrate 7 to the conduction pattern 23 and enters the LNA 20. Then, the signal is amplified by the LNA 20 and the amplified signal is sent to the output unit 22 via the conduction pattern 23. The signal sent to the output unit 22 is sent to a digital radio tuner via the cable 2. Then, in the input unit 21 and the output unit 22, electric fields are generated. However, these electric fields are induced by the through hole 24 provided between the input unit 21 and the output unit 22 to prevent the interference therebetween.

Next, a band-pass characteristic of the antenna apparatus 1 in this embodiment will be described.

Figure 8B:
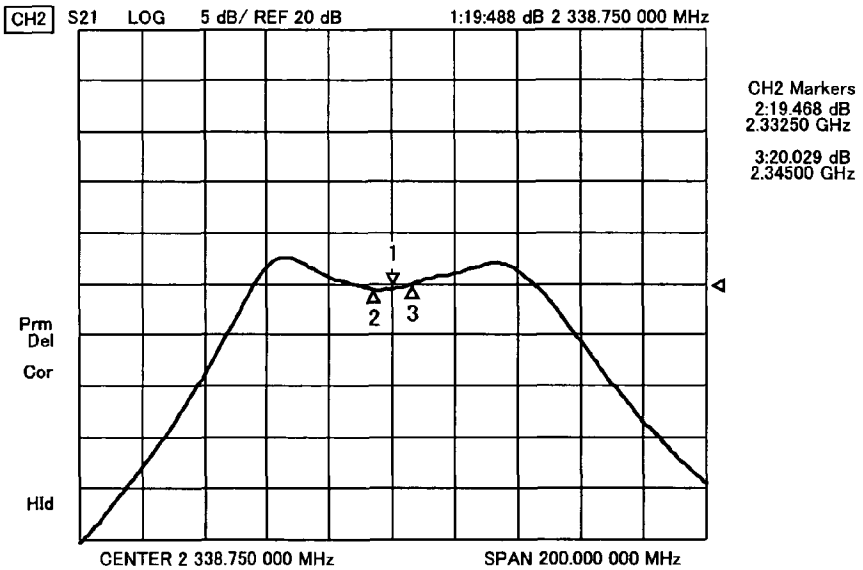
FIG. 8B is a graph showing a band-pass characteristic of a conventional antenna apparatus.
Figure 8A:
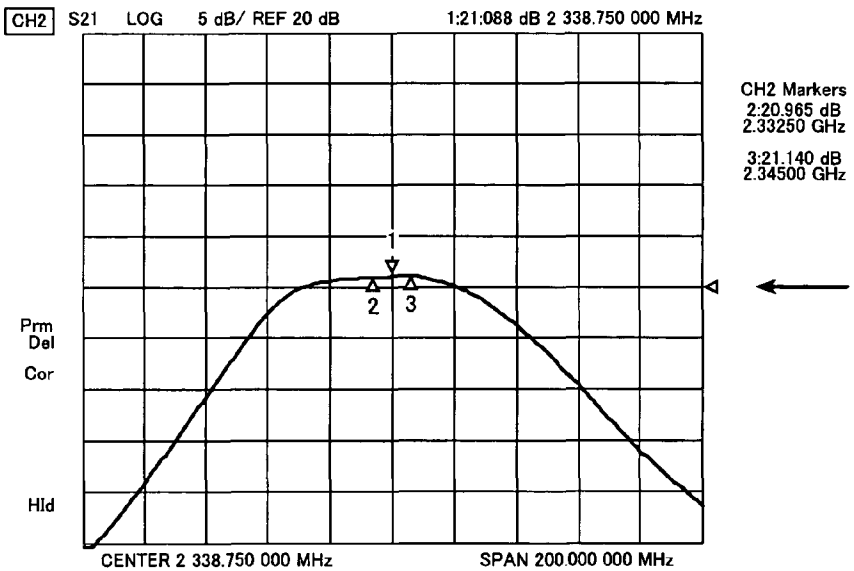
FIG. 8A is a graph showing a band-pass characteristic of the antenna apparatus according to this embodiment.
Figure 9:
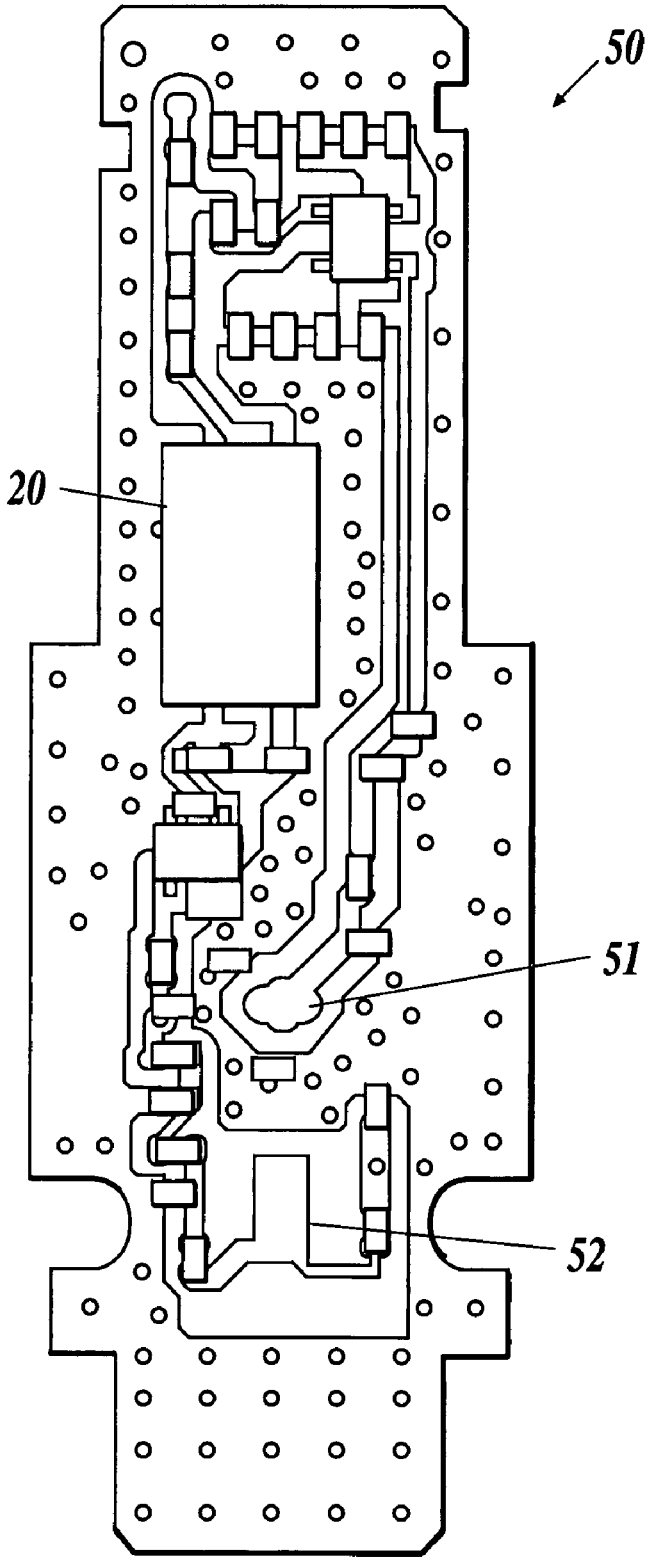
FIG. 9 is a plan view of a substrate of the antenna apparatus according to this embodiment.

FIG. 8B shows the band-pass characteristic of the conventional antenna apparatus 1 and FIG. 8A shows the band-pass characteristic of this embodiment. As shown in FIGS. 8A and 8B, even when the distance between the input unit 21 and the output unit 22 is equal, the isolation between the input unit 21 and the output unit 22 can be improved by providing the through holes 24. Also as shown in FIG. 8, in the antenna apparatus 1 according to the present invention, a curve of a band-pass characteristic has a flat portion and it is prevented that a a band-pass characteristic is decreased so that the curve thereof has a concave shape like the comparison example.

As described above, the antenna apparatus 1 of this embodiment is structured so that at least one conducting wire 14 and the output terminal 16 are provided in the cylindrical body 11 and the substrate 7 on which the LNA 20 is mounted is provided in the inner circumference of the cylindrical body 11 along the axial direction. On the lower part of the substrate 7, the input unit 21 for inputting a signal from the output terminal 16 and the output unit 22 for outputting a signal to the cable 2 are provided to be close to each other. However, because signals are separated between the input unit 21 and the output unit 22 by the through holes 24, it is possible to provide sufficient isolation between the input and the output. Thus, it is also possible to reduce signal leakage between the input and the output to prevent anomalous oscillation due to positive feedback.

Furthermore, according to the antenna apparatus 1 in which the substrate 7 is provided on the inner circumference side of the cylindrical body 11 like this embodiment, sufficient isolation can be obtained regardless of a distance between the input unit 21 and the output unit 22. Therefore, the substrate 7 is prevented from having a larger size. The output terminal 16 is provided at an end of the phase shifter pattern 15. Thus, the output terminal 16 is positioned at the lower part of the cylindrical body 11. Further, a region of the substrate 7, which is lower than the input unit 21 protrudes from the cylindrical body 11 to the lower side in the axial direction. However, according to the present invention, the input unit 21 also can be provided adjacent to the output unit 22 to reduce the region of the substrate 7, which protrudes from the cylindrical body 11 to the lower side in the axial direction. Therefore, the antenna apparatus 1 can have a smaller size in the axial direction.

Furthermore, because the through holes 24 are provided as a signal blocking unit, the signal blocking unit can have a simple structure and the isolation between an input and an output can easily secured.

Furthermore, by providing the antenna pattern including a plurality of conducting wires 14 and the phase shifter pattern, the phases of the electric waves received by the plurality of conducting wires 14 are adjusted by the phase shifter pattern 15 to synthesize the signals to one electric signal. Then, the electric signal is amplified by the LNA 20 and the amplified signal is sent to the digital radio tuner via the cable 2. Therefore, it is possible to enhance the receiver sensitivity higher than the case where electric waves are received by one conducting wire.

Furthermore, in the cylindrical body 11, the ground face 17 for functioning as a shield member is formed on the outer circumference of the phase shifter pattern 15. Thus, it is possible that the noise which influences on the characteristic of the antenna apparatus is relieved.

Furthermore, the space adjusting member 19 for adjusting the dielectric constant of the antenna pattern is provided in a space between the outer packaging case 3 and the cylindrical body 11. Thus, it is also possible to easily adjust the frequency characteristic of the antenna pattern of the cylindrical body 11.

In accordance with a first aspect of the preferred embodiment of the present invention, an antenna apparatus, comprises:

an antenna element; and a substrate on which a low noise amplifier is mounted and on which the antenna element is disposed, wherein the substrate comprises:

an input unit for inputting an electric signal into the low noise amplifier from an output terminal formed at a lower part of the antenna element;

an output unit for outputting the electric signal to a transmission unit connected to a signal processing unit for processing the electric signal from the antenna element; and a signal blocking unit provided between the input unit and the output unit.

According to a first aspect of the preferred embodiment of the present invention, in the antenna apparatus, the input unit for inputting a signal from the output terminal and the output unit for outputting a signal to the transmission unit are provided so as to be adjacent to each other on the lower part of the substrate. However, because signals are separated between the input unit and the output unit by the signal blocking unit, sufficient isolation between the input and the output can be secured. Thus, leakage of signals between the input and the output also can be reduced to prevent an anomalous oscillation due to a positive feedback. Further, the sufficient isolation also can be secured, it is not required to have a long distance between the input unit and the output unit. Thus, the substrate can be prevented from having a larger size and the antenna apparatus can have a smaller size.

Preferably, the antenna element comprises:

a cylindrical body formed by a flexible dielectric material film member;

an antenna pattern comprising at least one conducting wire that is formed on one face of the dielectric material film member.

According to the antenna apparatus, in the cylindrical body, the antenna pattern and the output terminal for outputting a signal to the low noise amplifier, are provided. On the inner side of the cylindrical body, the substrate on which the low noise amplifier is mounted is disposed along the axial direction.

Preferably, the signal blocking unit is a through hole provided in a region between the input unit and the output unit.

In this case, the substrate includes the through hole in the region between the input unit and the output unit. Thereby, an electric field between the input unit and the output unit is induced to isolate a signal. Thus, a signal blocking unit can have a simple structure and the isolation between an input and an output can be secured.

Preferably, the antenna pattern comprises a plurality of conducting wires, and a phase shifter pattern which is electrically connected to the antenna pattern is formed on the one face of the dielectric material film.

In this case, the antenna apparatus includes an antenna pattern including a plurality of conducting wires and a phase shifter pattern. Thus, phases of electric waves received by the plurality of conducting wires are adjusted by the phase shifter pattern to synthesize the waves. Then, the electric signal is amplified by the low noise amplifier to send the amplified signal to the signal processing unit via the transmission unit. Thus, a higher receiver sensitivity can be achieved as compared with a case where electric waves are received by one conducting wire.

Preferably, a ground face is formed at a position which is opposed to the phase shifter pattern, on the other face of the dielectric material film member, and the cylindrical body is formed so that the other face of the dielectric material film member is an outer face.

In this case, in a cylindrical body, a ground face for functioning as a shield member is formed on the outer side of the phase shifter pattern. Thus, it is possible that the entering of the noise which influences on the characteristic of the antenna apparatus enters the antenna apparatus is relieved.

Preferably, the antenna apparatus further comprises:

a tubular outer packaging case for covering the cylindrical body, in which a tip end in an axial direction is sealed; and a space adjusting member for adjusting a dielectric constant of the antenna pattern, the space adjusting member being provided in a space between the outer packaging case and the cylindrical body.

In this case, the antenna apparatus includes a space adjusting member for adjusting a dielectric constant of the antenna pattern, which is provided in a space between the outer packaging case and the cylindrical body. Thus, the frequency characteristic of the antenna pattern of the cylindrical body can be adjusted easily.

Preferably, the output unit and the input unit are disposed so as to face to each other across the signal blocking unit.

The entire disclosure of Japanese Patent Application No. 2006-255920 filed on Sep. 21, 2006 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An antenna apparatus comprising:

an antenna element; and a substrate on which a low noise amplifier is mounted and on which the antenna element is disposed, wherein the substrate comprises:

an input unit for inputting an electric signal into the low noise amplifier from an output terminal formed at a lower part of the antenna element;

an output unit for outputting the electric signal to a transmission unit connected to a signal processing unit for processing the electric signal from the antenna element; and a signal blocking unit provided between the input unit and the output unit;

wherein the antenna element comprises:

a cylindrical body formed by a flexible dielectric material film member; and an antenna pattern comprising at least one conducting wire that is formed on a first face of the dielectric material film member;

wherein the output unit and the input unit are disposed so as to face each other across the signal blocking unit; and wherein the substrate comprises an upper portion on which the low noise amplifier is disposed and a lower portion on which the output unit and the input unit are disposed so as to be close to each other, and wherein the upper portion is inserted in the cylindrical body and the lower portion is exposed from the cylindrical body.

2. The antenna apparatus as claimed in claim 1, wherein:

the signal blocking unit comprises a through hole provided in a region between the input unit and the output unit.

3. The antenna apparatus as claimed in claim 1, wherein:

the antenna pattern comprises a plurality of conducting wires, and a phase shifter pattern which is electrically connected to the antenna pattern is formed on the first face of the dielectric material film member.

4. The antenna apparatus as claimed in claim 3, wherein:

a ground face is formed at a position which is opposed to the phase shifter pattern, on a second face of the dielectric material film member, and the cylindrical body is formed so that the second face of the dielectric material film member is an outer face.

5. The antenna apparatus as claimed in claim 1, further comprising:

a tubular outer packaging case for covering the cylindrical body, wherein a tip end of the outer packaging case in an axial direction is sealed; and a space adjusting member for adjusting a dielectric constant of the antenna pattern, the space adjusting member being provided in a space between the outer packaging case and the cylindrical body.

* * * * *